US006508219B2

(12) United States Patent
Schorn

(10) Patent No.: US 6,508,219 B2
(45) Date of Patent: Jan. 21, 2003

(54) AIR FEEDING SYSTEM FOR AN INTERNAL-COMBUSTION ENGINE

(75) Inventor: Juergen Schorn, Rutesheim (DE)

(73) Assignee: Dr. Ing. h.c.F. Porsche Aktiengesellscaft, Weissach (DE)

( * ) Notice: Subject to any disclaimer, the term of this patent is extended or adjusted under 35 U.S.C. 154(b) by 0 days.

(21) Appl. No.: 09/873,105

(22) Filed: Jun. 4, 2001

(65) Prior Publication Data

US 2002/0033159 A1 Mar. 21, 2002

(30) Foreign Application Priority Data

Jun. 2, 2000 (DE) ..... 100 27 426

(51) Int. Cl.[7] ..... F02M 35/12
(52) U.S. Cl. ..... 123/184.57
(58) Field of Search ..... 123/184.57, 184.53, 123/184.55

(56) References Cited

U.S. PATENT DOCUMENTS 4,874,061 A 10/1989 Yanagida, et al.
5,572,966 A * 11/1996 Doddy et al. ..... 123/184.57
5,628,287 A * 5/1997 Brackett et al. ..... 123/184.55
5,647,314 A * 7/1997 Matsumura et al. ... 123/184.57
5,806,480 A * 9/1998 Maeda et al. ..... 123/184.57
5,839,405 A * 11/1998 Falkowski et al. ..... 123/184.53
6,178,940 B1 * 1/2001 Gossling et al. ..... 123/184.57

FOREIGN PATENT DOCUMENTS

| | | |
|---|---|---|
| DE | 197 43 482 | 4/1999 |
| FR | 2579677 | 10/1986 |
| WO | WO 98/49440 | 11/1998 |

OTHER PUBLICATIONS

Search Report.

* cited by examiner

*Primary Examiner*—Marguerite McMahon
(74) *Attorney, Agent, or Firm*—Crowell & Moring LLP

(57) ABSTRACT

An air guiding system is provided for an internal-combustion engine of a piston-type construction and includes an air filter and a feeding device for a suction system connected with cylinders of the internal-combustion engine. A receptacle, through which air flows, is arranged in a pipe between the air filter and the feeding device for influencing resonances. For optimizing the sound characteristics of the internal-combustion engine, the pipe is interrupted in the area of the receptacle, and a cross-section of the receptacle is larger than the cross-section of pipe sections of the pipe extending to the receptacle.

17 Claims, 2 Drawing Sheets

AIR FEEDING SYSTEM FOR AN INTERNAL-COMBUSTION ENGINE

BACKGROUND AND SUMMARY OF THE INVENTION

This application claims the priority of German Patent Document 100 27 426.9, filed in Germany, Jun. 2, 2000, the disclosure of which is expressly incorporated by reference herein.

The invention relates to an air feeding system for an internal-combustion engine comprising an air filter and a feeding device for a suction system connected with cylinders of the internal-combustion engine, a receptacle, through which air flows, being arranged in a pipe between the air filter and the feeding device for influencing resonances.

In a known air feeding system, as in International Patent Document WO 98/49440, of the initially mentioned type, a constructional unit is integrated in a pipe between an air filter and a feeding device, which constructional unit comprises pipe sections of the pipe and a resonator chamber.

In German Patent Document DE 197 43 482 A1, an intake port for an internal-combustion engine is shown, which intake port has a sound absorber with a shunt resonator. The shunt resonator is formed by a receptacle which is arranged at a distance from the intake port and is connected with the latter by way of a pipe.

An object of the invention is to optimize the sound characteristics of an internal-combustion engine by targeted measures in an air feeding system.

According to certain preferred embodiments of the invention, this object is achieved by way of the pipe which is interrupted in the area of the receptacle, and in a cross-section of the receptacle which is larger than a cross-section of pipe sections of the pipe when extended to the receptacle. Additional characteristics further developing the invention are contained in the claims.

An important characteristic achieved by way of certain preferred embodiments of the invention is that, as a result of the special design of the receptacle, the pipe resonances occurring between the volumes of the air filter and the feeding device in the pipe, which influence the radiation noises as well as the pressure pulsations of the above-mentioned pipe, are effectively damped. Low pressure pulsations contribute to the fact that relatively uniform air flows exist at the measuring devices for sensing the air flow, which is advantageous with respect to the measuring precision. Furthermore, a high sound quality of the intake sounds can be achieved by way of the receptacle, and the latter has a simpler construction than the so-called Helmholtz resonators.

Other objects, advantages and novel features of the present invention will become apparent from the following detailed description of the invention when considered in conjunction with the accompanying drawings.

DETAILED DESCRIPTION OF THE DRAWINGS

Figure 1:
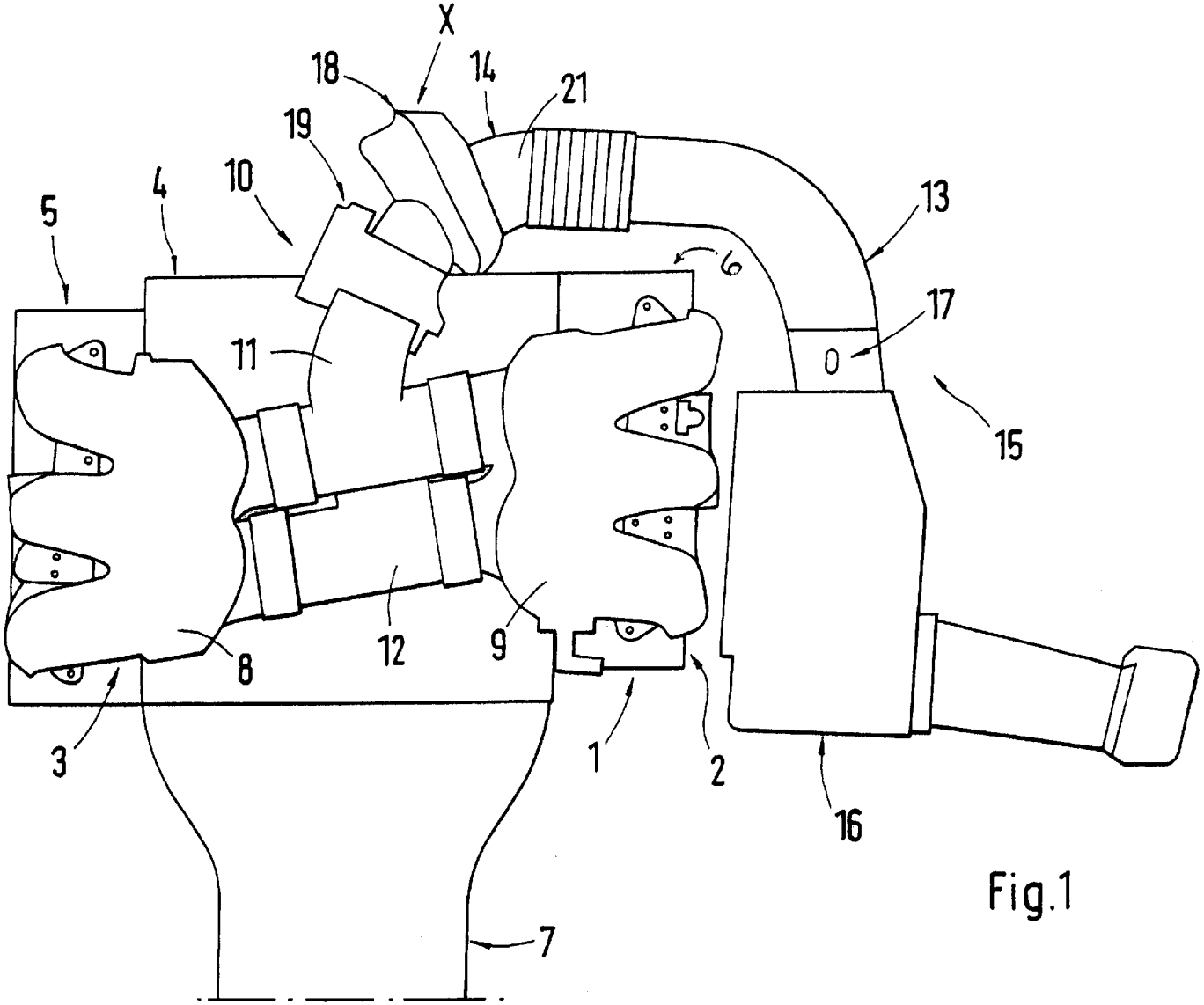
FIG. 1 shows a schematic top view of an internal-combustion engine with the air feeding system according to an embodiment of the invention.

A multi-cylinder internal-combustion engine 1 of a piston-type construction with opposed cylinder banks 2, 3 has a cylinder block and crankcase 4 with cylinder heads 5, 6, a transmission 7 being flanged to the cylinder block and crankcase 4. Intake vessels 8, 9 of a suction system 10 are connected with the cylinder heads 5, 6. The intake vessels 8, 9 are connected to a feeding device 11 and to a resonance pipe 12 which are components of an air feeding system 13. The air feeding system 13 is equipped with a pipe 14 which is provided on its free end 15 with an air filter 16. The pipe 14 extends between the feeding device 11 and the air filter 16 and downstream has an air flow sensor 17, a receptacle 18 for influencing resonances, and an electrically controlled throttle valve 19—also called E-gas—that is, the receptacle 18 is connected into the pipe 14 between the air flow sensor 17 and the throttle valve 19.

Figure 2:
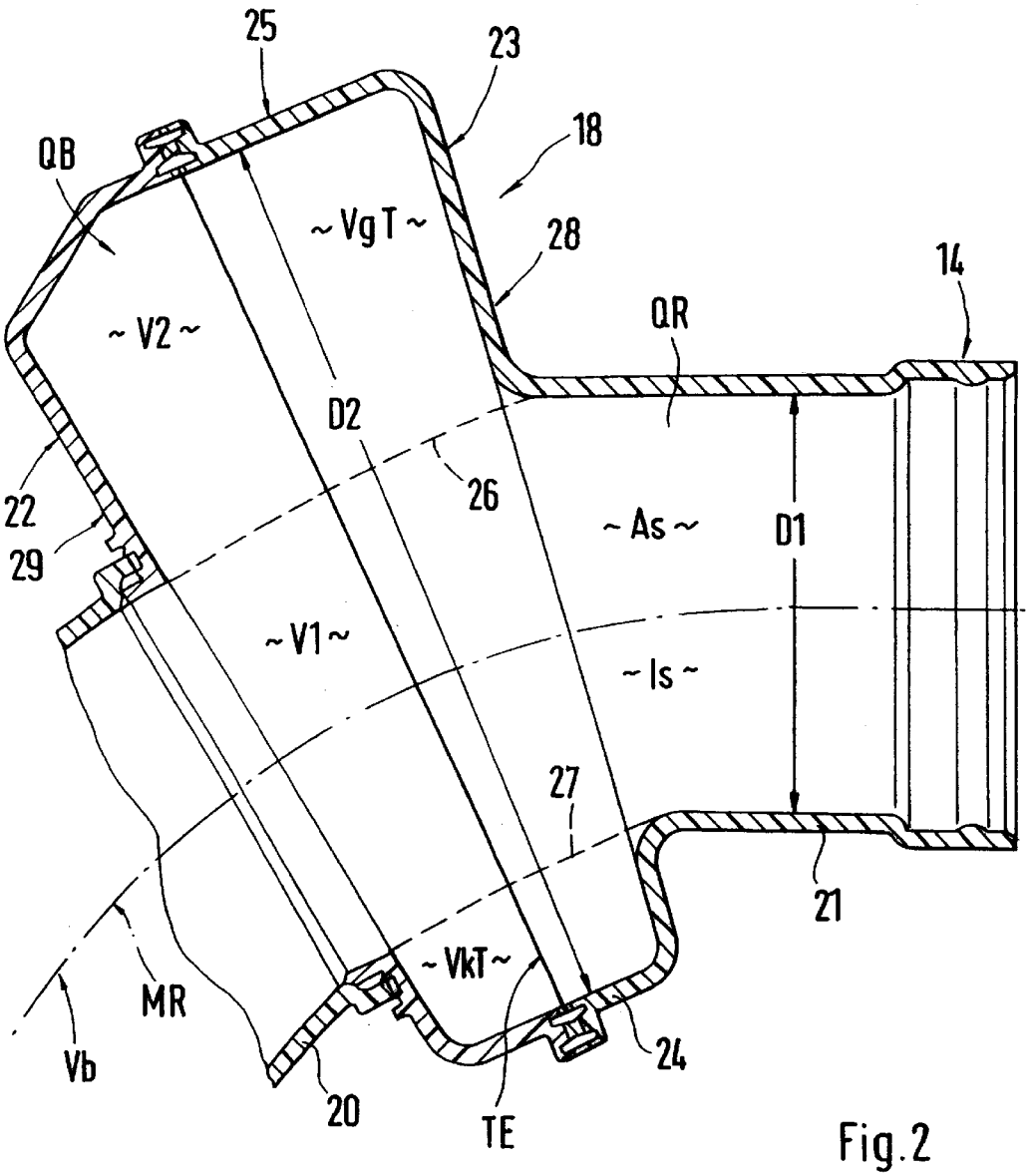
FIG. 2 shows an enlarged sectional view of a detail X of FIG. 1.

The pipe 14 is interrupted in the area of the receptacle 18, in FIG. 2, and the cross-section QB of the receptacle 18 is larger than the cross-section QR of the pipe 14 or of pipe sections 20 and 21 of the above-mentioned pipe, which are connected to boundary walls 22 and 23 of the receptacle 18. In the embodiment, the pipe 14 has a curved course Vb in the area of the receptacle 18, and the boundary walls 22, 23, together with additional boundary walls 24 and 25, form a trapezoidal cross-section. The pipe 14 and its pipe sections 20, 21 have a circular cross-section of a diameter D1 which is smaller than the largest diameter D2 of the receptacle 18. In this case, the largest diameter D2 of the receptacle 18 and the diameter D1 of the pipe sections 20, 21 are in the following mutual relationship:

$$\frac{D_2}{D_1} \geq 2$$

A good performance of the receptacle 18 is achieved in that, inside this receptacle 18, a first volume V1 formed by construction lines 26 and 27 of the diameter D1 is smaller than a second volume V2 of the receptacle 18, which volume V2 surrounds the first volume V1. In this context, it is advantageous for the first volume V1 and the second volume V2 to be in the following mutual relationship:

$$\frac{V_2}{V_1} \geq 2$$

The receptacle 18 is arranged asymmetrically with respect to a longitudinal center plane MR of the pipe 14, specifically with the stipulation that a larger portion of the volume VgT extends on the exterior side As of the longitudinal center plane MR, and a smaller portion of the volume VkT extends on the interior side Is of this longitudinal center plane.

For simplifying the production, the receptacle 18 is formed by two half shells 28, 29 which are fitted together in a junction plane TE extending transversely to the longitudinal center plane MR of the pipe 14 and of the pipe sections 20, 21. In addition, preferably, the pipe 14 and the receptacle 18 are made of plastic, at least the half shell 28 and the pipe section 21 being produced from one piece.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. Air feeding system for an internal-combustion engine of a piston-type construction, comprising an air filter and a feeding device for a suction system connected with cylinders of the internal-combustion engine, a receptacle, through which air flows, being arranged in a pipe between the air filter and the feeding device for influencing resonances, wherein the pipe is interrupted in the area of the receptacle, wherein a cross-section of the receptacle is larger than a cross-section of pipe sections of the pipe adjacent to the receptacle, and wherein, in the area of the receptacle, the pipe has a curved course, and the receptacle has an approximately trapezoidal cross-section.

2. Air feeding system according to claim 1, wherein the pipe sections of the pipe are connected to boundary walls of the receptacle.

3. Air feeding system according to claim 1, wherein at least the cross-section of the pipe sections of the pipe has a circular construction.

4. Air feeding system according to claim 3, wherein a largest diameter of the cross-section of the receptacle and the diameter of the cross-section of pipe sections have a mutual relationship $$\frac{D2}{D1} \geq 2$$

5. Air feeding system according to claim 3, wherein a first volume, which is defined inside the receptacle by extension of the diameter of the pipe sections is smaller than a second volume of the receptacle which surrounds the first volume.

6. Air feeding system according to claim 5, wherein the first volume and the second volume are in the mutual relationship $$\frac{V2}{V1} \geq 2$$

7. Air feeding system according to claim 1, wherein the receptacle is arranged asymmetrically with respect to a longitudinal center axis of the pipe and of the pipe sections.

8. Air feeding system according to claim 1, wherein a larger portion of a volume of the receptacle and a smaller portion of the volume of the receptacle are arranged in such a manner with respect to a longitudinal center axis of the pipe and of the pipe sections that the larger portion of the volume extends on a side of the longitudinal center axis.

9. Air feeding system according to claim 7, wherein a larger portion of a volume of the receptacle and a smaller portion of the volume of the receptacle are arranged in such a manner with respect to a longitudinal center axis of the pipe and of the pipe sections that the larger portion of the volume extends on a side of the longitudinal center axis.

10. Air feeding system according to claim 1, wherein the receptacle is formed by two half shells which are fitted together in a plane extending transversely to the longitudinal center plane of the pipe and of the pipe sections.

11. Air feeding system according to claim 1, wherein the pipe and the receptacle are plastic.

12. Air feeding system according to claim 10, wherein at least one of the half shells of the receptacle together with one of the pipe sections is one piece.

13. A receptacle assembly according to claim 1, wherein the receptacle is arranged asymmetrically with respect to a longitudinal center axis of the pipe.

14. A receptacle assembly through which air flows for an air guiding system of an internal-combustion engine, comprising:

a receptacle being arranged in a pipe between an air filter and a feeding device for influencing resonances, wherein a cross section of the receptacle is larger than a cross-section of the pipe adjacent the receptacle, and wherein the cross-section of the receptacle is approximately trapezoidal.

15. A method of making an air guiding system for an internal-combustion engine of piston-type construction, comprising:

providing a pipe, connecting an air filer to the pipe, connecting a feeding device for a suction system connected with cylinders of the engine, and arranging a receptacle, through which air flows, in the pipe between the air filter and the feeding device for influencing resonances, wherein the pipe is interrupted in an area of the receptacle and a cross-section of the receptacle is larger than a cross-section of the pipe adjacent the receptacle, the cross-section of the receptable being approximately trapezoidal.

16. A method according to claim 15, wherein the receptacle is formed by two half shells which are fitted together in a plane extending transversely to the longitudinal center plane of the pipe.

17. A method according to claim 16, wherein at least one of the half shells of the receptacle and a section of the pipe is one piece.

* * * * *